United States Patent [19]

Gammons et al.

[11] 4,347,633

[45] Sep. 7, 1982

[54] PATIENT TREATING MATTRESS

[75] Inventors: Clifford E. Gammons, Indianapolis, Ind.; Francis C. Moore, Cape Coral, Fla.; Kenneth L. Pagel, Manitowoc; Barry N. Jackson, De Pere, both of Wis.

[73] Assignee: American Hospital Supply Corporation, Evanston, Ill.

[21] Appl. No.: 171,051

[22] Filed: Jul. 22, 1980

[51] Int. Cl.[3] ..... A61G 7/04

[52] U.S. Cl. ..... 5/453; 5/456; 128/33

[58] Field of Search ..... 5/455, 453, 454, 449, 5/456; 128/33

[56] References Cited

U.S. PATENT DOCUMENTS

| | | | |
|---|---|---|---|
| 3,113,326 | 12/1963 | Hyde et al. | 5/500 |
| 3,148,391 | 9/1964 | Whitney | 5/456 |
| 3,199,124 | 8/1965 | Grant | 5/453 |
| 3,253,861 | 5/1966 | Howard | 5/449 |
| 3,467,081 | 9/1969 | Glass | 128/33 |
| 3,653,083 | 4/1972 | Lapidus | 5/450 |
| 3,678,520 | 7/1972 | Evans | 5/456 |
| 4,149,541 | 4/1979 | Gammons et al. | 5/453 |
| 4,197,837 | 4/1980 | Trinagli et al. | 128/33 |

FOREIGN PATENT DOCUMENTS

| | | | |
|---|---|---|---|
| 1007768 | 3/1977 | Canada | 5/81 B |
| 949652 | 2/1964 | United Kingdom | 5/453 |

*Primary Examiner*—Alexander Grosz

*Attorney, Agent, or Firm*—Larry Barger; Donald L. Barbeau

[57] ABSTRACT

A disposable or resuable "crawl resistant" flexible mattress formed of panels sealed together to define alternately inflatable passages between the panels for sequentially altering supporting structure for a long term bed patient to reduce decubitus ulcers, bed sores, etc. The mattress has vent holes in its top for ventilating the patient with inflation gas and a crawl resistant layer bonded to a bottom of the mattress to prevent the mattress from "crawling" relative to the bed and patient during use. In one form of the mattress, crawling is reduced by a separation between the inflation passages so individual sections of the mattress can more readily conform to a patient's body contour.

25 Claims, 9 Drawing Figures

PATIENT TREATING MATTRESS

BACKGROUND

It is known to treat patients for decubitus ulcers, bed sores, etc. with a mattress having alternatingly inflatable structures on the mattress for providing alternating support areas for the patient. Some of these mattresses include holes in a top of the mattress for venting a portion of the inflating gas, such as air, to further treat the patient. Examples of such mattresses are described in the following U.S. Pat. Nos.: Armstrong, 2,998,817; Glass, 3,467,081; Lapidus 3,653,083; and Tringali et al., 4,197,837, all of which have ventilating openings. Examples of patient treating pads without ventilation openings are described in the following U.S. Pat. Nos.: Bates et al., 2,896,612; Grant, 3,199,124; and Whitney 3,701,173.

A major problem with prior patient treatment mattresses on the market which had alternatingly inflatable structures was their tendency to "crawl" during use. This crawling was also aggravated by movement of the patient upon the mattress. Some such mattresses after a period of time were found to be sticking out the side of the patient's bed with the patients almost being unsupported by the treatment mattress. The reason for this problem is not fully understood, but it is believed that the sequential inflation and deflation of portions of the mattress acts somewhat like raising and lowering alternating feet of a multi-legged caterpillar or worm causing such caterpillar to "crawl." The exposed surface of these mattresses were usually of a thermoplastic film material, and the outer surface of such thermoplastic film may also contribute to a very small, almost imperceptible sliding motion of the inflated structures on the mattress during each inflation and deflation cycle.

To overcome the "crawling" problem, the manufacturers of alternatingly inflatable patient support mattresses have utilized expensive, full width end extensions of the mattresses, such as shown at 16 in Grant, U.S. Pat. No. 3,199,124, for folding over and tucking under the complete width of a conventional mattress upon which the patient treatment mattress rests. Such end extensions, which have been made of a very thick plastic material for firm control, cause the patient treating mattress to be very expensive, thus necessitating the recleaning of the mattress for use with many different patients. Current mattresses on the market cannot be economically disposed of after a single patient use as is highly desirable to reduce the chance of cross-contamination between patients.

It should be noted that different kind of pads, such as shown in the Gammons et al. U.S. Pat. No. 4,149,541, do not have the "crawl" problem because they do not alternately inflate different passages. Instead, such pads are continuously inflated with a circulating liquid and there is no sequential inflation and deflation of adjoining sections. A fabric layer on such continuously inflated pads is primarily for comfort at patient's skin contact or for retaining a liquid on the surface for hot or cold liquid therapy.

SUMMARY OF THE INVENTION

The applicants have unexpectedly found that "crawl" can be substantially reduced by the incorporation of a crawl resistant layer, such as a nonwoven fabric, on at least one external surface of the thermoplastic panels forming the mattress. Preferably, this crawl resistant layer is secured directly to a panel that has nonlinear passages, such as zigzag or intersecting T-shapes, in a portion of the mattress adapted to support the major weight of the patient. In one form of the invention, the inflatable passages are separated along a central portion of the mattress so that inflated protruding sections of the mattress can more readily conform to the contour of a patient's body. The mattress is formed of panels sealed together, and either one or both of the panels can be preformed by vacuum or pressure molding. Such molding during the manufacture of the mattress causes a flexible protruding pattern on such panel to provide less strain at the sealed areas between the panels forming the mattress. This construction for a patient treatment mattress is intended for one-patient use. It is also suitable for mattresses incorporating thicker plastic panel members intended for multi-patient use.

THE DRAWINGS

DETAILED DESCRIPTION

Figure 1:
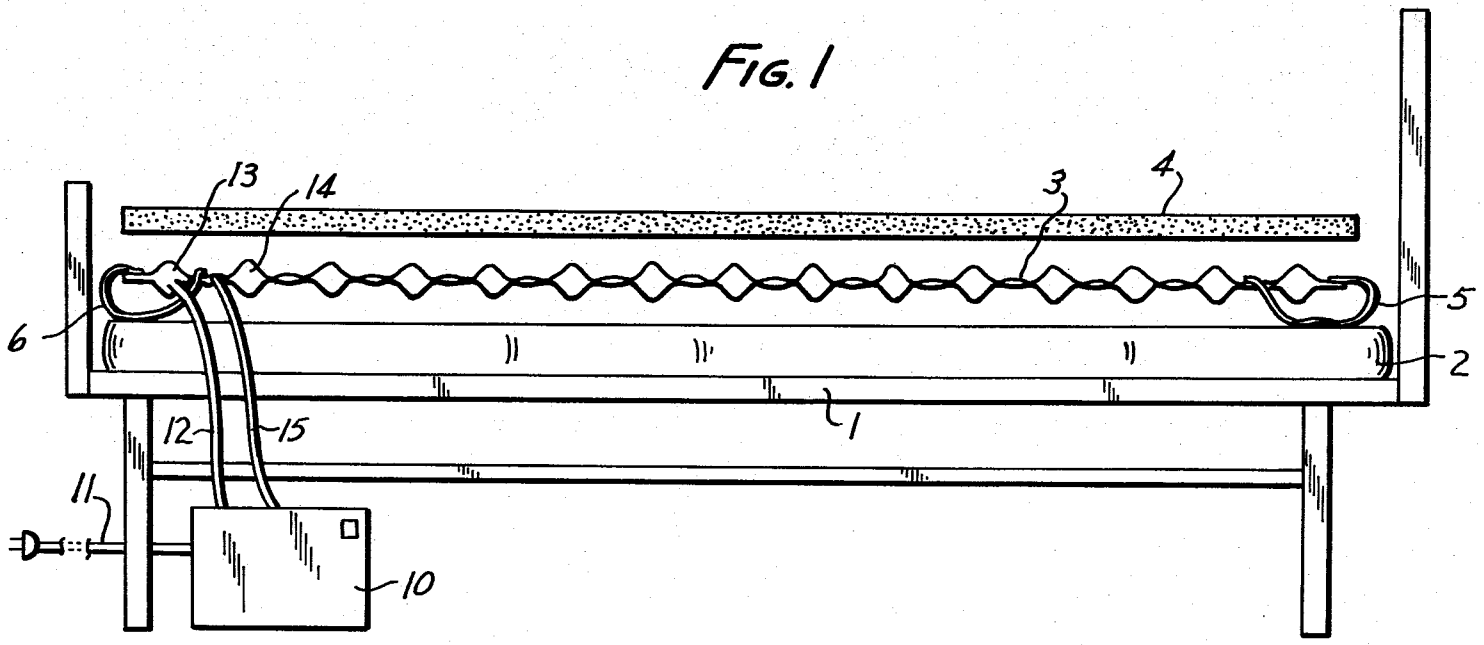
FIG. 1 is an exploded side elevational view of a bed with the patient treatment mattress.

In the exploded view of FIG. 1, a bed 1 is shown supporting a conventional mattress 2. Superimposed upon conventional mattress 2 is a patient treating mattress 3 over which lies a porous gas ventilating diffusion pad 4. Pad 4 can be of an open cell foam material.

During use the patient treatment mattress 3 can be secured to corners of the conventional mattress 2 by corner loops 5 and 6. Preferably, these loops are on each of the four corners of the patient treatment mattress. As will be explained later, the reduced crawl tendency of the present invention eliminates the need for the elongated end flaps of prior patient treatment pads that wrapped around ends of the conventional mattress 2 across the entire width of the mattress in an effort to stabilize the patient treatment mattress. Prior attempts to use less than the expensive end flaps with marketed patient treatment mattresses resulted in excessive crawl or mobility of the mattress beneath the patient.

The patient treatment mattress 3 has at least two sets of independent massaging passages that are alternately inflated by a pumping means designated at 10 which can be energized by electrical source through cord 11. In FIG. 1, a tube 12 is inflating passages, such as 13 and 14, in the patient treatment mattress. During this cycle of inflation, the set of passages connecting with tube 15 are in a deflated mode.

Figure 2:
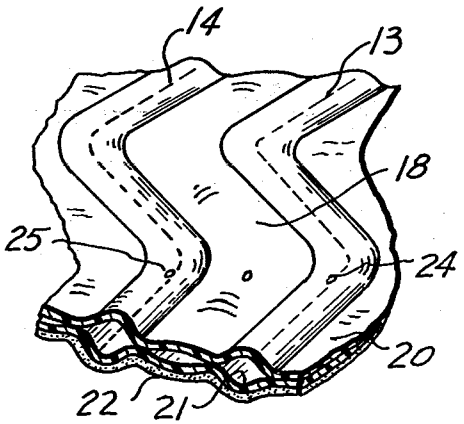
FIG. 2 is a fragmentary prospective view showing the contour of a patient supporting section of the mattress.

In the first embodiment of the mattress shown in FIG. 2, passages 13 and 14 are shown in inflated condition with a passage 18 located therebetween being in deflated condition. The passages 13 and 14 have left and right bends which preferably extend over the entire area of the surface, but most importantly in the area to support the major weight of the patient, such as the buttocks area. When the passages 13 and 14 are inflated, upstanding ridges form in a top panel 20 of the patient treatment mattress and a corresponding downwardly extending ridge protrudes from a bottom panel 21. Panels 20 and 21 can be of thermoplastic material having a thickness in the range of 0.003 to 0.020 inch. A mattress of polyurethane material in which the bottom layer is 0.005 inch thick and a top layer of 0.009 inch thick works very well for an economical, reliable, disposable mattress.

Secured to a bottom surface of bottom panel 21 is a crawl resistant layer 22 which can be a nonwoven fabric. It has been found in actual practice that the nonwoven fabric layer 22 tends to reduce the "crawling" of the mattress when the passages 13 and 14 are alternately inflated and deflated in an opposite manner to passage 18. In this first embodiment, the passages have both left and right bends and form a zigzag configuration as shown in FIG. 2. During inflation of the respective sets of passages, vent holes such as 24 and 25 permit a portion of the inflating gas, such as air, to ventilate the patient through the porous pad 4. If desired, vertical holes could be through both top and bottom panels, such as shown as 24 and **24*a* of FIG. 3**, so the mattress could be reversible.

Figure 4:
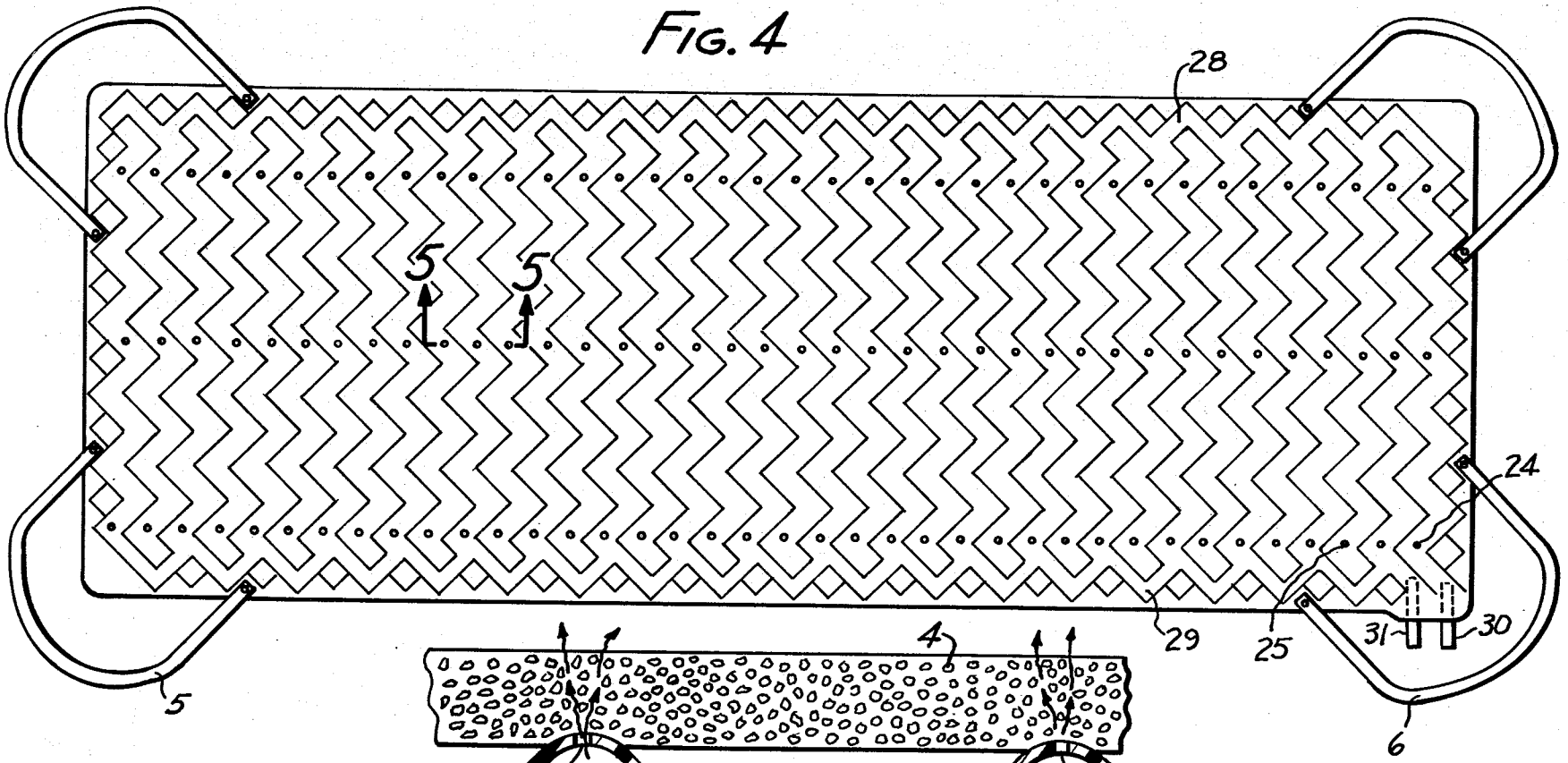
FIG. 4 is a top plan view of the first embodiment of the mattress showing a zigzag pattern of the inflation channels.

In FIG. 4, the full top view of the mattress of the first embodiment is shown with the passages having left and right bends. First and second manifold sections 28 and 29 extending longitudinally along opposed edges of the mattress are formed by top and bottom panels of the mattress. These manifold sections connect respectively to separate sets of the inflatable passages extending transversely across the mattress. Connecting ports 30 and 31 connect to the manifold respectively and join through tubes 12 and 15 (not shown in FIG. 4) to the pumping means 10. In FIG. 4, three rows of vent holes are shown in the patient treatment mattress.

Figure 5:
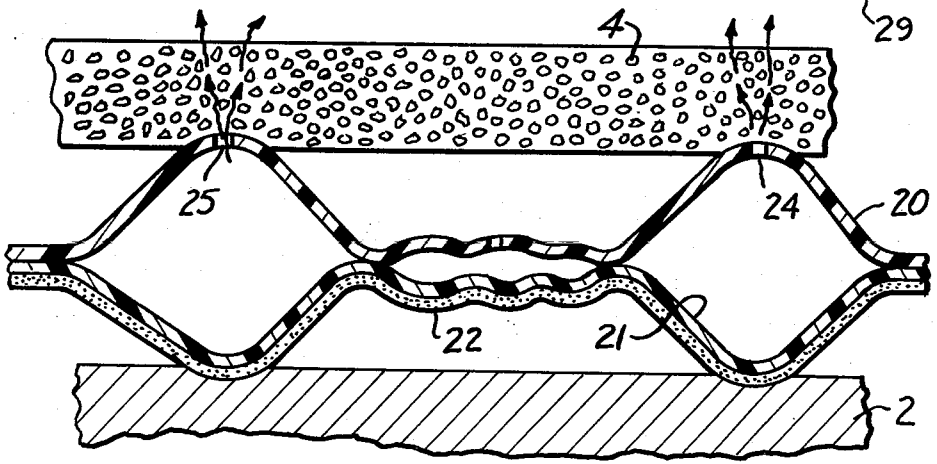
FIG. 5 is a sectional view taken along line 5—5 of FIG. 4.
Figure 9:
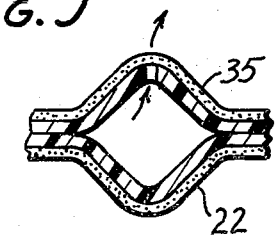
FIG. 9 is a sectional view taken along an inflation passage of the mattress showing an alternate embodiment in which crawl resistant layers are bonded to both top and bottom of the mattress.

In the enlarged cross-sectional view of FIG. 5, the operation of the mattress is shown in more detail. Here the crawl resistant layer 22 alternately changes its pressure contact with the conventional supporting mattress 2 as different sets of the passages are inflated and deflated in sequence. This crawl resistant layer 22 is believed to help prevent the very minute lateral sliding with each inflation and deflation cycle and thus support the mattress in a stable manner beneath the patient through numerous inflation and deflation cycles. A crawl resistant layer, such as 22, can also be sealed to the upper surface of panel 20, but here such crawl resistant layer must be sufficiently porous to permit exit of gas through holes 24 and 25 when it is desired to use a ventilating type patient treatment mattress. Such upper crawl resistant layer is shown at 35 in FIG. 9. Crawl resistant layer 35 can have a porosity either through natural openings or through formed perforations for passing vetilating gas through crawl resistant layer 35.

Figure 3:
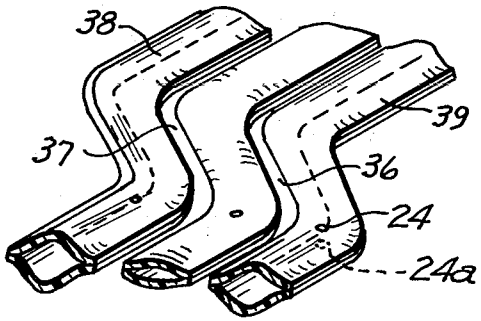
FIG. 3 is a fragmentary sectional view showing a second embodiment of the patient supporting area of the mattress with inflatable passages separated by cuts in the mattress.
Figure 7:
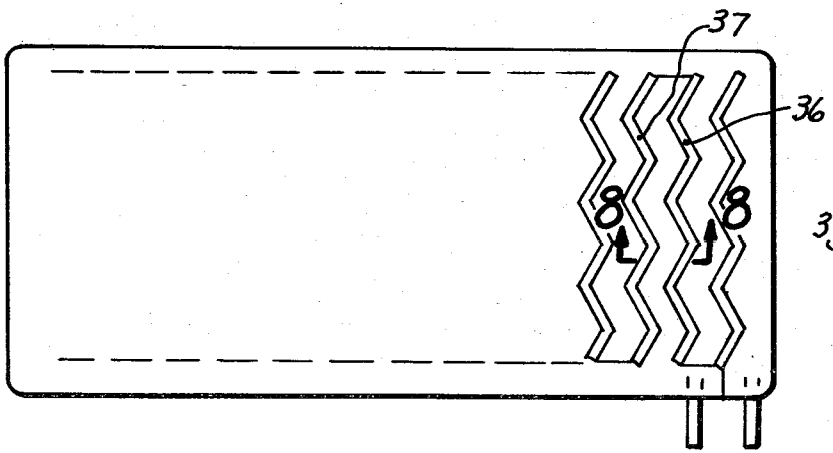
FIG. 7 is a reduced top plan view showing the mattress of the second embodiment with separations between inflation channels.

In a second embodiment of the invention, the applicants have unexpectedly found that "crawl" can be reduced by forming a separation, such as 36 and 37 of FIG. 3, between inflatable passages 38 and 39. Thus, the individual inflatable passages and the respective ridges they create can move independently of each other for more readily conforming to the contour of a patient's body. This separation between the inflatable passages can be made by a cut through the top and bottom panels at the time the top and bottom panels are heat sealed to each other through a fusion process. FIG. 7 shows a mattress with inflatable passages having a few left and right bends with separations between the passages designated at 36 and 37. These separation areas can be formed by a simple cut, which is preferred, or if desired, material can be removed from these separation areas to form a wider spacing as shown in FIG. 8.

Figure 8:
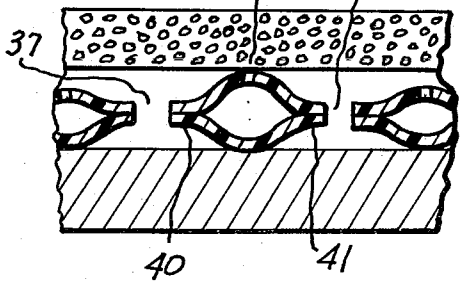
FIG. 8 is an enlarged sectional view taken along line 8—8 of FIG. 7.

As shown in FIG. 8, the inflation of a particular passage tends to create a substantial peeling stress on a heat seal between the top and bottom panels of the mattress. This peeling stress occurs with each inflation cycle along inner edges of the heat seals because the top and bottom panels were of originally flat material at the time of forming the heat seal. This peeling stress can be reduced by vacuum or pressure forming the top and bottom panels into the general configuration of flexible ridges shown in the mattresses described in this application.

Figure 6:
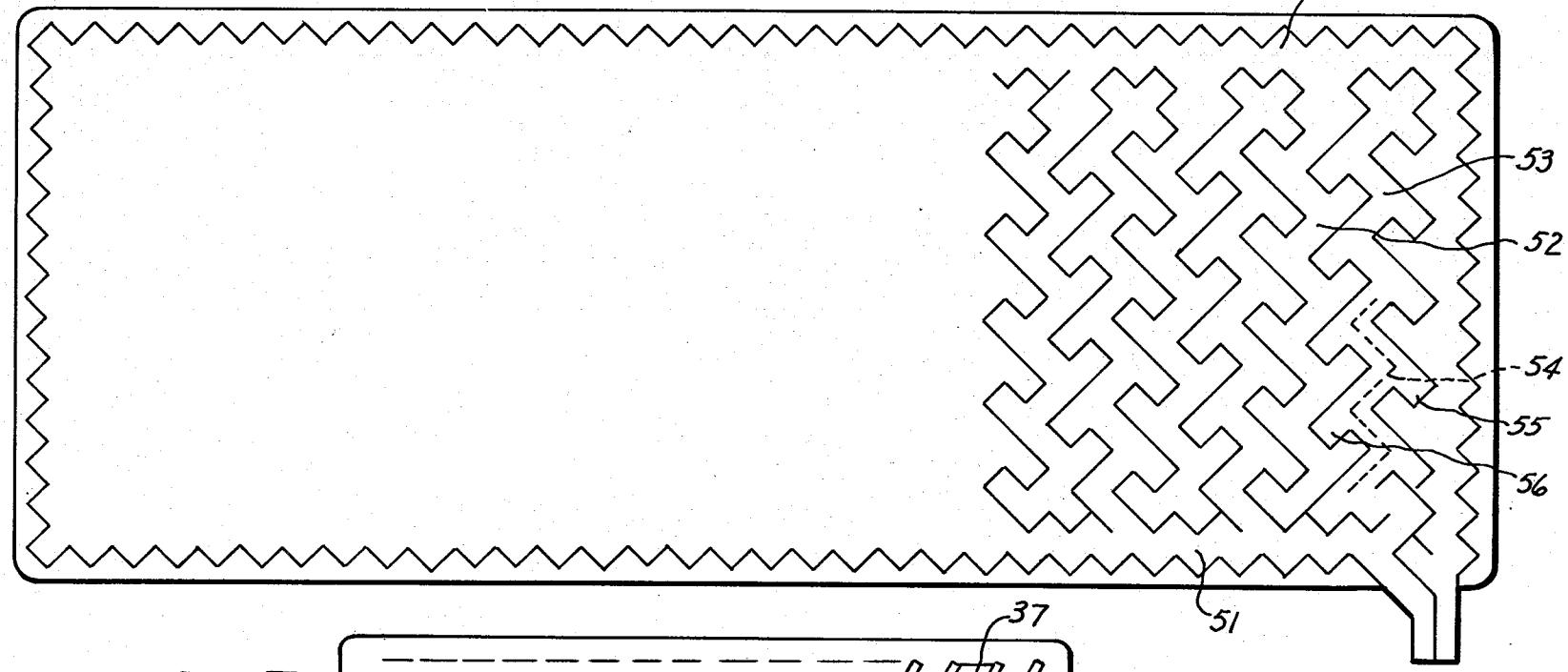
FIG. 6 is a top plan view of a third embodiment of the mattress showing the inflation passages being formed with interconnecting T-shapes.

FIG. 6 shows a third embodiment of the mattress in which a manifold 50 and a manifold 51 with left and right bends interconnect to separate sets of inflatable passages such as indicated at 52 and 53. Here each passage has left and right bends forming a backbone ridge system as shown in dotted line at 54 in FIG. 6. Interconnecting rib ridges, such as 55 and 56, communicate with the backbone ridge system to form the pattern of interconnecting T-shaped passages. In this embodiment, as well as the first and second embodiments, the inflation passages have boundaries which define a generally uniform width, although not linear, of the passages so that a ridge that is inflated has a sufficiently uniform height so as to form an elongated crest system for supporting the patient.

In the foregoing description, specific examples have been used to describe this invention. However, it is understood by those skilled in the art that certain modifications can be made to these examples without departing from the spirit and scope of the invention.

We claim:

1. A "crawl resistant" flexible mattress comprising: a bottom panel; a top panel sealed to the bottom panel to define at least two alternatingly inflatable structures on the mattress, and a continuous crawl resistant layer bonded to a substantial portion of the outer surface of at least one of the panels to follow the contour of the alternatingly inflatable structures on the mattress to reduce crawl of the mattress during use.

2. A mattress as set forth in claim 1, wherein the crawl resistant layer is bonded to the bottom panel.

3. A "crawl resistant" flexible mattress with alternatingly inflatable structures on the mattress comprising: a bottom panel; a top panel sealed to the bottom panel to define at least two separate sets of passages with left and right bends in an area of the mattress that is to support the major weight of a patient; at least two flexible manifolds formed by the top and bottom panels, each manifold being spaced apart from each other with the manifolds being connected at different locations in the mattress to respective sets of passages for inflatingly forming a series of protruding backbone ridges in at least one of the panels, each backbone ridge having a sufficiently uniform height along its length to form an elongated supporting crest with left and right bends; a continuous crawl resistant layer bonded to a substantial portion of the outer surface of at least one of the panels so that the crawl resistant layer follows the contour of the elongated supporting crest; and vent openings extending to the top panel into the passages for ventilating a patient during inflation of the passages with a gas.

4. A mattress as set forth in claim 3, wherein both top and bottom panels have vertical openings so the mattress is reversible.

5. A mattress as set forth in claim 3, wherein the mattress is generally rectangular with the manifolds extending along opposite edges of the mattress.

6. A mattress as set forth in claim 3, wherein the crawl resistant layer is bonded to the bottom panel.

7. A mattress as set forth in claim 3, wherein the crawl resistant layer is bonded to the top panel, and is sufficiently porous for passing ventilating gas through the crawl resistant layer.

8. A mattress as set forth in claim 7, wherein the porous crawl resistant layer bonded to the top panel has natural openings for passing ventilating gas therethrough.

9. A mattress as set forth in claim 7, wherein the porous crawl resistant layer bonded to the top panel has perforations for passing ventilating gas therethrough.

10. A mattress as set forth in claim 3, wherein there is a crawl resistant layer bonded to both the top and bottom panels, with the crawl resistant layer bonded to the top panel being sufficiently porous for passage of ventilating gas from the vent openings.

11. A mattress as set forth in claim 10, wherein the porous crawl resistant layer bonded to the top panel has natural openings for passing ventilating gas therethrough.

12. A mattress as set forth in claim 8, wherein the porous crawl resistant layer is bonded to the top panel has perforations for passage of ventilating gas therethrough.

13. A mattress as set forth in claim 3, wherein the crawl resistant layer is a fabric.

14. A mattress as set forth in claim 3, wherein the crawl resistant layer is a nonwoven fabric.

15. A mattress as set forth in claim 3, wherein there is on top of the mattress a ventilating gas dispersion pad.

16. A mattress as set forth in claim 15, wherein the pad is of a foam material.

17. A mattress as set forth in claim 3, wherein the ridges are preformed in a panel.

18. A mattress as set forth in claim 3, wherein the manifolds have left and right bends.

19. A mattress as set forth in claim 3, wherein the portion of the mattress panel between the passages is discontinuous so that each protruding structure can move independently of the other.

20. A "crawl resistant" flexible mattress with alternatingly inflatable structures on the mattress comprising: a bottom panel; a top panel sealed to the bottom panel to define at least two separate sets of passages in an area of the mattress that is to support the major weight of a patient; at least two flexible manifolds formed by the top and bottom panels, each manifold being spaced from the other and connected at a different location in the mattress to a set of passages for inflatingly forming protruding structures in at least one of the panels; a continuous crawl resistant layer bonded to a substantial portion of the outer surface of at least one of the panels so that the crawl resistant layer follows the contour of the protruding structure; and vent openings extending through the top panel to the passages for ventilating the patient during inflation of the passages with a gas.

21. A mattress as set forth in claim 20, wherein the crawl resistant layer is a nonwoven fabric.

22. A "crawl resistant" flexible mattress with alternatingly inflatable structures on the mattress comprising: a bottom panel; a top panel sealed to the bottom panel to define at least two separate sets of passages that are non-linear in an area of the mattress that is to support the major weight of the patient; at least two flexible manifolds formed by the top and bottom panels, each manifold being spaced apat from the other and connected at different locations in the mattress to a respective set of passages for inflatingly forming protruding backbone ridges along the non-linear passages, each backbone ridge having a parality of rib ridges laterally intersecting the backbone ridge; and each backbone ridge and its inner connecting rib ridges having a sufficiently uniform height to form an elongated supported crest along the backbone ridge as well as interconnecting supporting crest of the rib ridges; a continuous crawl resistant layer bonded to a substantial portion of the outer surface of at least one of the panels so that the crawl resistant layer follows the contour of such crests; and vent openings extending to the top panel into the passages for ventilating the patient during inflation of the passages with a gas.

23. A mattress as set forth in claim 22, wherein such backbone ridge and its interconnecting rib ridges are formed by interconnecting T-shapes.

24. A method of reducing the "crawling" of a flexible mattress relative to a bed and patient during use, said mattress having a top panel sealed to a bottom panel to define at least two alternatingly inflatable structures thereon, comprising: bonding a continuous crawl resistant layer to a substantial portion of the outer surface of said mattress to follow the contours of the alternatingly inflatable structures.

25. The method of claim 24, wherein the crawl resistant layer is a non-woven fabric.

* * * * *